United States Patent [19]

Yoshihara et al.

[11] Patent Number: 4,792,507

[45] Date of Patent: Dec. 20, 1988

[54] ELECTROPHOTOGRAPHIC MEMBER WITH SURFACE LAYER HAVING FLUORINE RESIN POWDER AND FLUORINE GRAFT POLYMER

[75] Inventors: Toshiyuki Yoshihara, Mitaka; Masaaki Hiro, Kanagawa; Tomohiro Kimura, Kawasaki, all of Japan

[73] Assignee: Canon Kabushiki Kaisha, Tokyo, Japan

[21] Appl. No.: 26,176

[22] Filed: Mar. 16, 1987

[30] Foreign Application Priority Data

| | | | |
|---|---|---|---|
| Mar. 18, 1986 | [JP] | Japan | 61-58153 |
| Mar. 5, 1987 | [JP] | Japan | 62-51774 |
| Mar. 11, 1987 | [JP] | Japan | 62-54096 |

[51] Int. Cl.[4] ..... G03G 5/14

[52] U.S. Cl. ..... 430/58; 430/66; 430/67

[58] Field of Search ..... 430/58, 59, 66, 67

[56] References Cited

U.S. PATENT DOCUMENTS

| | | | |
|---|---|---|---|
| 3,859,090 | 1/1975 | Yoerger et al. . | |
| 4,232,101 | 11/1980 | Fukada et al. | 430/56 |
| 4,663,259 | 5/1987 | Fujimura et al. | 430/58 |
| 4,675,262 | 6/1987 | Tanaka | 430/58 |

FOREIGN PATENT DOCUMENTS

| | | | |
|---|---|---|---|
| 56-25749 | 3/1981 | Japan | 430/67 |
| 57-74748 | 5/1982 | Japan | 430/67 |
| 58-162958 | 9/1983 | Japan | 430/67 |
| 59-188655 | 10/1984 | Japan | 430/66 |
| 59-197042 | 11/1984 | Japan | 430/67 |

OTHER PUBLICATIONS

McMullen, "Overcoated Electrostatographic Photoreceptor", Xerox Discl. Jour., vol. 2, #4, Jul./Aug. 1977, p. 15.

*Primary Examiner*—Roland E. Martin

*Attorney, Agent, or Firm*—Fitzpatrick, Cella, Harper & Scinto

[57] ABSTRACT

An electrophotographic photosensitive member having a photosensitive layer on an electroconductive substrate comprises a surface layer containing a fluorine type resin powder and a fluorine type graft polymer.

20 Claims, No Drawings

ELECTROPHOTOGRAPHIC MEMBER WITH SURFACE LAYER HAVING FLUORINE RESIN POWDER AND FLUORINE GRAFT POLYMER

BACKGROUND OF THE INVENTION

1. Field of the Invention

This invention relates to an electrophotographic photosensitive member, more particularly to an electrophotographic photosensitive member of high durability excellent in humidity resistance and mechanical strength.

2. Related Background Art

An electrophotographic photosensitive member is required to have prescribed sensitivity, electrical characterictics and optical characteristics corresponding to the electrophotographic process to be applied. Further, in a photosensitive member which is used repeatedly, since electrical and mechanical external force such as corona charging, toner development, transfer onto paper, cleaning treatment, etc., is directly applied onto the surface layer of the photosensitive member, namely the layer which is the remotest from the substrate, durability to those forces is required.

More specifically, durability to generation of abrasion or damage by the friction of the surface or to deterioration of the surface by ozone generated during corona charging under humid conditions is required.

On the other hand, there is also the problem of toner attachment onto the surface layer by repeated development of toner and cleaning, and to cope with this problem, improvement of the cleaning characteristic of the surface layer has been demanded.

In order to satisfy the characteristics required for the surface layer as mentioned above, various methods have been investigated. Among them, the means of dispersing fluorine type resin powder into the surface layer is effective. By dispersion of fluorine type resin powder, the frictional coefficient of the surface layer is lowered to act on improvement of the cleaning characteristic as well as improvement of durability to abrasion damage.

Also, since water-repellent property and mold-release property of the suface layer can be improved, it is also effective against prevention of the surface deterioration and highly humidity conditions.

However, in fluorine resin powder dispersion, problems are involved in its dispersibility and agglomerating tendency, and since it is difficult to form a uniform and smooth film, the surface layer obtained could not avoid having image defects such as image irregularities or pinholes.

Also, although some binder resins or dispersing aids can disperse uniformly fluorine type resin powder to form a smooth film, in most cases, due to having hydroxyl groups, carboxyl groups, ether bonds, etc., carrier traps are formed particularly under high temperature and highly humid conditions to cause deterioration in electrophotographic characteristics. Thus, under the present situation, no practically available binder resin or dispersing aid can be found.

SUMMARY OF THE INVENTION

The present invention is intended to provide an electrophotographic photosensitive member which should respond to the requirements as mentioned above.

That is, a first object of the present invention is to provide an electrophotographic photosensitive member having durability to abrasion of the surface or generation of scraper by friction.

A second object is to provide an electrophotographic photosensitive member capable of obtaining an image which is stable and of high quality even under highly humid conditions.

A third object is to provide an electrophotographic photosensitive member which is good in cleaning characteristic and without adhesion of toner onto the surface layer.

A fourth object of the present invention is to provide an electrophotographic photosensitive member capable of obtaining always an image of high quality without coating irregularity or pinhole on the surface, and also without accumulation of residual potential in the repeated electrophotographic process.

According to the present invention, there is provided an electrophotographic photosensitive member having a photosensitive layer on an electroconductive substrate, which comprises a surface layer containing a fluorine type resin powder and a fluorine type graft polymer.

The present inventors have investigated along the above objects, and consequently found that an electrophotographic photosensitive member having a surface layer containing fluorine type resin powder dispersed in the presence of a fluorine type graft polymer can respond to the requirements as described above to accomplish the present invention.

DETAILED DESCRIPTION OF THE PREFERRED EMBODIMENTS

That is, the present invention is constituted of an electrophotographic photosensitive member having a photosensitive layer on an electroconductive substrate, which comprises a surface layer containing a fluorine type resin powder and a fluorine type graft polymer.

The fluorine type resin powder to be applied in the present invention may be selected from at least one of tetrafluoroethylene resins, trifluorochloroethylene resins, tetrafluoroethylene-hexafluoropropylene resins, vinyl fluoride resins, vinylidene fluoride resins, difluorochloroethylene resins and copolymers thereof, preferably tetrafluoroethylene resins and vinylidene fluoride resins. The molecular weight of the resin and the size of the powder may be optionaly selected from the commercial grades, but those of lower molecular weight grades and having primary particles of 1 $\mu$ or less are preferred.

The content of the fluorine type resin powder dispersed in the surface layer may be suitably 1 to 50 wt. %, particularly preferably 2 to 30 wt. % based on the solid weight in the surface layer. With a content less than 1 wt. %, the effect of improving the surface layer with the fluorine type resin powder is not sufficient, while a content over 50 wt. % will lower light transmittance and also lower mobility of carriers.

The fluorine type graft polymer to be applied in the present invention can be obtained by copolymerization of an oligomer containing a polymerizable functional group at one terminal end a molecular weight of about 1000 to 10000 and also having certain repeating units (hereinafter called macromer) with a polymerizable monomer.

The fluorine type graft polymer has a structure comprising:

(i) a trunk of a fluorine type segment and a branch of a non-fluorine type segment in the case of copolymerization of a non-fluorine type macromer synthesized from a non-fluorine type polymerizable monomer with a fluorine type polymerizable monomer, or (ii) a trunk of a non-fluorine type segment and a branch of a fluorine type segment in the case of copolymerization of a fluorine type macromer synthesized from a fluorine type polymerizable monomer and a non-fluorine type polymerizable monomer.

The fluorine type graft polymer has fluorine type segments and non-fluorine type segments localized respectively as described above, and takes the function separation form in which the fluorine type segments are oriented toward the fluorine type resin powder, and the non-fluorine type segments toward the resin layer added, respectively. Particularly, since the fluorine type segments are arranged continuously, the fluorine type segments can be adsorbed at high density and with good efficiency onto the fluorine type resin powder, and further the non-fluorine type segments are oriented toward the resin layer, whereby the improvement effect of dispersion stability of the fluorine type resin powder not found in the dispersing agent of the prior art can b exhibited. Also, fluorine type resin powder generally exists as agglomerated masses of several $\mu$ order, but by use of the fluorine type graft polymer of the present invention as the dispersing agent, the powder can be dispersed uniformly to primary particles of 1 $\mu$ or less. For making available such function separation effect to the full extent, the molecular weight of the macromer is required to be controlled to about 1000 to 10,000 as described above. That is, if the molecular weight is less than 1000, because the length of the segments is too short, adsorption efficiency to the fluorine type resin powder is reduced in the case of fluorine segments, while orientation toward the surface layer resin layer is weakened in the case of non-fluorine type segments, whereby dispersion stability of the fluorine type resin powder is inhibited in either case. On the other hand, if the molecular weight exceeds 10,000, compatibility with the resin layer of the surface layer added will be reduced. Particularly, this phenomenon is marked in the fluorine type segments, and because the segment will take a shrinked coil-like form in the resin layer, the number of active adsorption points onto the fluorine type resin powder will be reduced, whereby dispersion stability is inhibited.

Also, the molecular weight of the fluorine type graft polymer itself gives a great influence, and the preferable range is from 10,000 to 100,000. If the molecular weight is less than 10,000, the function of dispersion stability can be insufficiently exhibited, while if it is in excess of 100,000, compatibility with the surface resin layer added will be reduced, whereby similarly the function of dispersion stability cannot be exhibited.

The ratio of the fluorine type segments in the fluorine type graft polymer should be preferably 5 to 90 wt/%, more preferably 10 to 70 wt. %. With a ratio of the fluorine type segments less than 5 wt. %, the function of dispersion stability of the fluorine type resin powder cannot be fully exhibited, while with a ratio exceeding 90 wt. %, compatibility with the surface layer resin added will be worsened.

The fluorine type graft polymer added may be appropriately 0.1 to 30 % by weight of the fluorine type resin powder, particularly preferably 1 to 20 %. With an amount added of less than 0.1 %, the effect of dispersion stability of the fluorine type resin powder is not sufficient. At a level in excess of 30 %, the fluorine type graft polymer will exist internally of the surface resin in the free state in addition to the polymer existing adsorbed onto the fluorine type resin. Accumulation of residual potential will occur when electrophotographic process is performed repeatedly when such excess of graft polymer is employed.

In the following, preferable examples of the fluorine type graft polymer to be used in the present invention are shown.

A-1 : the fluorine type graft polymer is a copolymer of a non-fluorine type oligomer of the general formula (I) having a polymerizable functional group at one terminal end and also having certain repeating units and a fluorine type polymerizable monomer selected from the compounds (II):

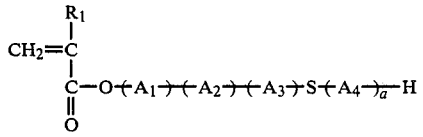

(I)

$R_1$: hydrogen atom, alkyl group, halogen atom, halo-substituted alkyl group, aryl group;

$A_1$: alkylene chain, halo-substituted alkylene chain;

$A_2$:

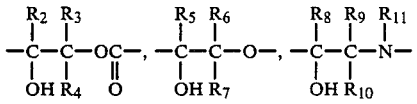

$R_2$–$R_{11}$: hydrogen atom, alkyl group, halo-substituted alkyl group;

$A_3$: alkylene chain, halo-substituted alkylene chain;

$A_4$ repeating unit comprising a polymer of at least one polymerizable monomer selected from low molecular weight straight chain unsaturated hydrocarbons, vinyl halides, vinyl esters of organic acids, vinylaromatic compounds, acrylic acid and methacrylic acid esters, N-vinyl compounds, vinylsilicon compounds, maleic anhydride, esters of maleic acid and fumaric acid;

a: positive integer;

Compounds (II): fluorine-substituted low molecular weight straight chain unsaturated hydrocarbons, fluorine-substituted vinyl halides, fluorine-substituted vinyl esters of organic acid vinyl esters, fluorine-substituted alkyl vinyl ethers, fluorine-substituted alkyl esters and amides of acrylic acid and methacrylic acid, fluorine-substituted aromatic containing esters and amides of acrylic acid and methacrylic acid, fluorinated maleic anhydride, fluorine-substituted alkyl esters of maleic acid and fumaric acid, $\alpha$-fluorinated styrene and $\alpha,\beta,\beta$-fluorinated styrene.

A-2 the fluorine type graft polymer is a copolymer of a fluorine type oligomer of the formula (III) having a polymerizable functional group at one terminal end and also having certain repeating units and a non-fluorine type polymerizable monomer selected from the compounds (IV).

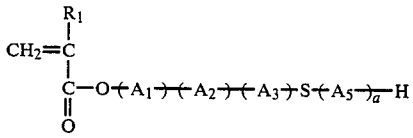

(III)

$A_5$: repeating unit comprising a polymer of at least one polymerizable monomer selected from fluorine-substituted low molecular weight straight chain unsaturated hydrocarbons, fluorine-substituted vinyl halides, fluorine-substituted organic acid vinyl esters, fluorine-substituted alkyl vinyl ethers, fluorine-substituted alkyl esters and amides of acrylic acid and methacrylic acid, fluorine-substituted aromatic containing esters and amides of acrylic acid and methacrylic acid, fluorinated maleic anhydride, fluorine-substituted alkyl esters of maleic acid and fumaric acid, α-fluorinated styrene and α, β,β-fluorinated styrene;

$R_1$, $A_1$, $A_2$, $A_3$ and a have the same meanings as defined above;

Compounds (IV): low molecular weight straight chain unsaturated hydrocarbons, vinyl halides, vinyl esters of organic acids, vinyl aromatic compounds, acrylic acid and methacrylic acid esters, N-vinyl compounds, vinylsilicon compounds, maleic anhydride, esters of maleic acid and fumaric acid.

Synthesis of the macromer in A-1 can be accomplished according to the method as disclosed in U.K. Patent No. 1,096,912 in which a prepolymer such as carboxylic acid, alcohol and the like at the terminal end is synthesized by radical polymerization with the use of a continuous chain transfer agent, and double bonds are introduced with the reaction of an epoxy group. A synthesis example of a macromer of methyl mechacrylate is shown by the synthesis scheme (1).

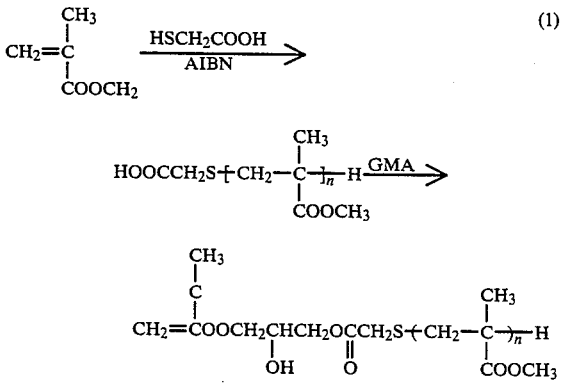

(1)

By copolymerization of the thus synthesized methyl methacrylate macromer with a fluorine type polymerizable monomer, a fluorine type graft polymer having fluorine type segment in the trunk and nonfluorine type segments (methyl methacrylate oligomer) in the branch can be obtained.

The fluorine type polymerizable monomer may be a compound having fluorine atoms in the molecule and also having a polymerizable functional group, and can be polymerized according to the reaction mode corresponding to its functional group.

Preferable specific examples of the fluorine type polymerizable monomer are shown below, but the scope of available compounds is not limited at those to those mentioned here. Specific examples of fluorine type polymerizable monomer:

| Compound No. | |
|---|---|
| (1) | $CH_2=CHF$ |
| (2) | $CH_2=CF_2$ |
| (3) | $CHF=CF_2$ |
| (4) | $CF_2=CF_2$ |
| (5) | $CF_2=CFCl$ |
| (6) | $CF_2=CFCF_3$ |
| (7) | $CF_2=CF-Rf$ |
| (8) | $CF_2=CF-O-Rf$ |
| (9) | $CH_2=CH-Rf$ |
| (10) | $CH_2=CH-O-Rf$ |
| (11) | 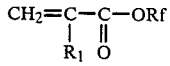 |
| (12) | 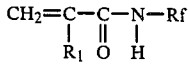 |
| (13) | 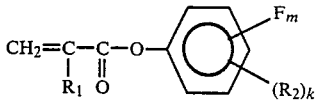 |
| (14) | 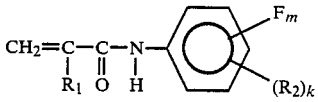 |
| (15) | 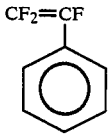 |
| (16) | 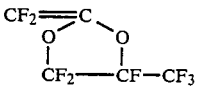 |

(in the above compound, $R_1$ represents hydrogen atom, halogen atom or methyl group; $R_2$ represents hydrogen atom, halogen atom, alkyl group, alkoxy group or nitrile group or a combination of several kinds thereof; k is an integer of 1 to 4, m is an integer of 1 to 5 and k+m=5; $R_f$ represents an alkyl group which is substituted with one or more fluorine atoms.)

As the non-fluorinetype polymerizable monomer, there may be employed at least one of low molecular weight straight chain unsaturated hydrocarbons, vinyl halides, vinyl esters of organic acids, vinylaromatic compounds, acrylic acid and methacrylic acid esters, N-vinyl compounds, vinylsilicon compounds, maleic anhydride, esters of maleic acid and fumaric acid, but it is necessary to select one which is compatible with the resin layer of the surface layer in which the fluorine type graft polymer formed is added or, even if not completely compatible therewith, has a similar structure, thus having affinity even to a small extent between the both. For example, when the surface resin layer is a poly(meth)acrylic acid ester, it is preferable to select a (meth)acrylic acid ester as the non-fluorine type polymerizable monomer, while a styrene type compound should preferably selected in the case of polystyrene or polycarbonate. In the macromer synthesis of methyl methacrylate as described above, by use of a fluorine type polymerizable monomer in place of methyl methacrylate, a fluorine type macromer can be obtained and from copolymerization of the macromer with a non-fluorine type polymerizable monomer, a fluorine type graft polymer containing branches of a fluorine type segment and trunks of non-fluorine type segments can be obtained.

B-1: the fluorine type graft polymer is a copolymer of a non-fluorine type oligomer of the formula (V) having a polymerizable functional group at one terminal end and also having certain repeating units and a fluorine type polymerizable monomer selected from the compound (II).

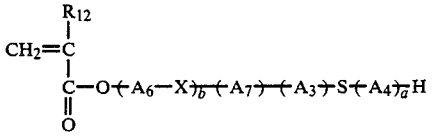

(V)

$R_{12}$: hydrogen atom, alkyl group, halogen atom, halo-substituted alkyl group;
$A_6$: alkylene chain;
X:

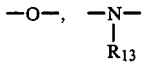

$R_{13}$: hydrogen atom or alkyl group;
b: 0 or positive integer;
$A_7$:

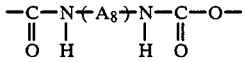

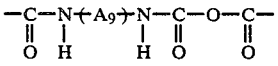

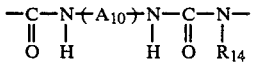

R14: hydrogen atom, alkyl group;

$A_8$, $A_9$, $A_{10}$: alkylene chain, cycloalkylene chain, substituted or unsubstituted arylene chain,

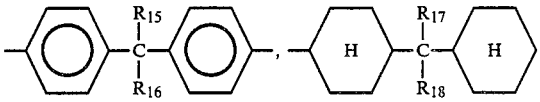

$R_{15}$, $R_{16}$, $R_{17}$, $R_{18}$: hydrogen atom, alkyl group, or $R_{15}$ and $R_{16}$ or $R_{17}$ and $R_{18}$ may form a ring through an alkylene chain;
$A_3$, $A_4$, a and the compounds (II) have the same meanings as defined above.

B-2: the fluorine type graft polymer is a copolymer of a fluorine type oligomer of the formula (VI) having a polymerizable functional group at one terminal end and also having certain repeating units and a non-fluorine type polymerizable monomer selected from the compounds (IV).

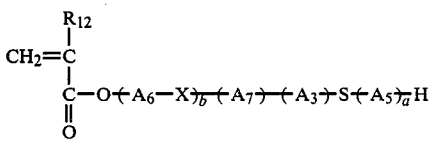

(VI)

wherein $R_{12}$, x, $A_3$, $A_5$, $A_6$, $A_7$, a, b and the compounds (IV) have the same meanings as defined above.

Synthesis of the macromer in B-1 can be accomplished by the method as disclosed in USP 3,689,593 wherein a prepolymer with carboxylic acid or alcohol at the terminal end is synthesized by radical polymerization with the use of a continuous chain transfer agent and double bonds are introduced by the reaction with isocyanate groups. A synthesis example of the macromer of methyl methacrylate is shown by the synthesis scheme (2):

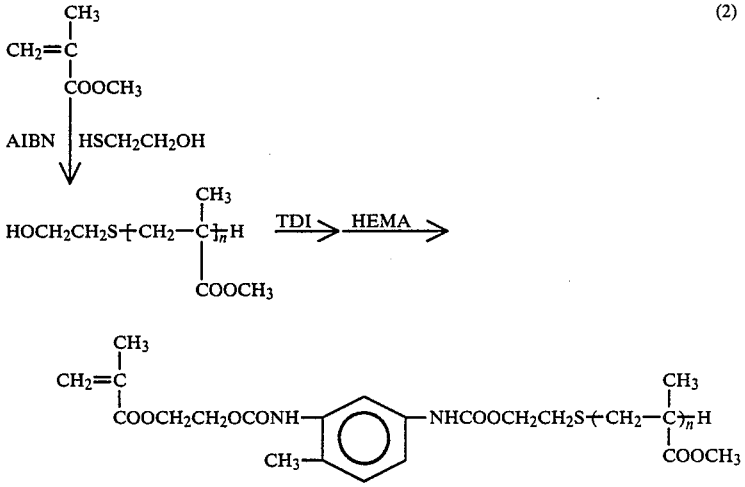

(2)

Also by copolymerization of the thus synthesized methyl methacrylate macromer with a fluorine type polymerizable monomer, a fluorine type graft polymer having fluorine type segments in the trunk and non-fluorine type segments (methyl methacrylate oligomer) in the branch can be obtained similarly as described above.

In the macromer synthesis of methyl methacrylate as described above, by use of a fluorine type polymerizable monomer in place of methyl methacrylate, a fluorine type macromer can be obtained and from copolymerization of the macromer with a non-fluorine type polymerizable monomer, fluorine type graft polymer having fluorine type segments in the branch and non-fluorine type segments in the trunk can be obtained.

C-1: the fluorine type graft polymer is a copolymer of a non-fluorine type oligomer formed by the reaction of a living polymer intermediate of the formula (VII) having a polymerizable functional group at one terminal end and having certain repeating units with compounds represented by the formula (VIII) and a fluorine type polymerizable monomer selected from the compounds (II).

$$(R_{19}A_{11n}R_{20}-O]_m)^{\ominus}+M^{\oplus} \qquad \text{(VII)}$$

$R_{19}$: hydrogen atom, alkyl group, aryl group;

$A_{11}$: repeating unit comprising a polymer of at least one selected from styrene, α-alkylstyrene, α-olefin, (meth)acrylic acid ester, a-cyano(meth)acrylic acid ester;

n: positive integer;

$R_{20}$: alkylene chain;

m: 0 or positive integer;

$$CH_2{=}\underset{\underset{R_{21}}{|}}{C}\text{-}(A_{12})_c\text{-}(A_{13})_d\text{-}Y \qquad \text{(VIII)}$$

$R_{21}$: hydrogen atom, alkyl group, aryl group;

$A_{12}$:

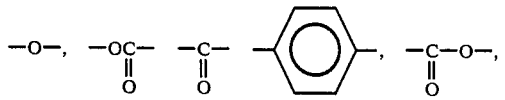

C: 0 ro 1;

$A_{13}$: substituted or unsubstituted alkylene chain; d; 0 or 1;

Y: halogen atom.

Synthesis of the macromer in C-1 can be accomplished by use of the anion polymerization method as disclosed in U.S. Pat. No. 3,786,116 and U.S. Pat. No. 3,928,255 in which a compound having unsaturated double bond is used as the stopping agent. A macromer synthesis example of styrene is shown by the synthesis scheme (3):

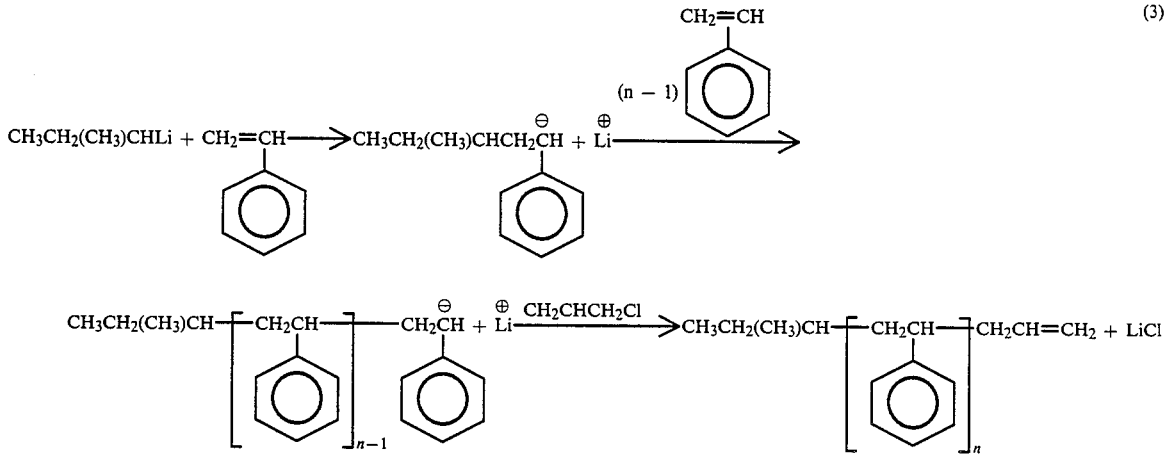

(3)

By copolymerization of the thus synthesized styrene macromer with a fluorine type polymerizable monomer, a fluorine type graft polymer having fluorine type segments in the trunk and non-fluorine type segment (styrene oligomer) in the branch can be obtained.

In this case, the polymerizing component of the macromer is required to be selected from those having compatibility with the resin layer of the surface layer in which the fluorine type graft polymer formed is added or, even if not completely compatible, having similar structures, thus having affinity even to a small extent between the both.

For example, when the surface resin layer is a poly(-meth)acrylic acid ester, the macromer polymerizing component may be also preferably a (meth)acrylic acid ester, while a styrene type compound should preferably selected in the case of polystyrene or polycarbonate.

The binder resin for forming the surface layer may be a polymer having film forming property, but it may be preferably polymethacrylate, polystyrene, methacrylic acid ester/styrene copolyme, polycarbonate, polyallylate, polyester, polysulfone, etc., from and the like The binder should have sufficient hardness and should not interfere with transport of carriers.

In preparation of the electrophotographic photosensitive member of the present invention, the electroconductive substrate used may be a cylindrical cylinder or a film having an electroconductive layer containing electroconductive particles dispersed in an appropriate binder resin provided on a support made of a metal such as aluminum, stainless steel, etc., or paper, plastic, etc. However, when the support itself is electroconductive, no electroconductive layer may be provided on the electroconductive substrate.

On these substrate, a subbing layer (adhesion layer) having the barrier function and the subbing function can be provided.

The subbing layer is provided for the purpose of improving adhesiveness of the photosensitive layer, improving coatability, protecting the substrate, covering the defects on the substrate, improving charge injectability from the substrate, protecting the photosensitive layer against electrical destruction, etc. As the material for the subbing layer, there have been known polyvinyl alcohol, poly-N-vinylimidazole, polyethylene oxide, ethyl cellulose, methyl cellulose, ethylene-acrylic acid copolymer, casein, polyamide, copolymerized nylon, glue, gelatin, etc.

These are applied as solutions dissolved in respective appropriate solvent, the film thickness may be about 0.2 to 2μ.

As the charge generating substance, there may be employed cyanine type dyes, azulene type dyes, squarium type dyes, pyrylium type dyes, thiapyrylium type dyes, phthalocyanine type pigments, anthanthrone type pigments, dibenzpyrenequinone type pigments, pyranthorone type pigments, azo type pigments such as monoazo pigments, disazo pigments, trisazo pigments, etc., indigo type pigments, quinacridone type pigments, nonasymmetric quinocyanine, quinocyanine, etc.

Examples of the charge transporting substance may include pylene; carbazoles such as N-ethylcarbazole, N-isopropylcarbazole, N-methyl-N-phenylhydrazino-3-methylidene-9-ethylcarbazole, N,N-diphenylhydrazino-3-methylidene- 9-ethylcarbazole; N,N-diphenylhydrazino-3-methylidene-10-ethylphenothiazine; N,N-diphenylhydrazino-3-ethylidene-10-ethylphenoxazine; hydrazones such as p-diethylaminobenzaldehyde-N,N-diphenylhydrazone, p-diethylaminobenzaldehyde-N-α-naphthyl-N-phenylhydrazone, p-pyrrolidinobenzaldehyde-N,N-diphenylhydrazone, 1,3,3-trimethylindolenine-ω-aldehyde-N,N-diphenylhydrazone, p-diethylbenzaldehyde-3-methylbenzthiazolinone2-hydrazone, etc.; pyrazolines such as 2,5-bis(p-diethylaminophenyl)-1,3,4-oxadiazole, 1-phenyl-3-(p-diethylaminostyryl)-5-(p-diethylaminophenyl)-pyrazoline, 1-[quinolyl(2)]-3-(p-diethylaminostyryl)-5-(p-diethylaminophenyl)pyrazoline, 1-[pyridyl(2)]-3-(p-diethylaminostyryl)-5-(p-diethylaminophenyl)pyrazoline, 1-[6-methoxypyridyl(2)]-3-(p-diethylaminostyryl)-5-(p-diethylaminophenylpyrazoline, 1-[pyridyl(3)]-3-(p-diethylaminostyryl)-5-(p-diethylaminophenyl)pyrazoline, 1-[pyridyl(2)]-3-(p-diethylaminostyryl)5-(p-diethylaminophenyl)pyrazoline, 1-[pyridyl(2)]-3-(p-diethylaminostyryl)-4-methyl-5-(p-diethylaminophenyl)-pyrazoline, 1-[pyridyl(2)]-3-(α-methyl-p-diethylaminostyryl)-5-(p-diethylaminophenyl)pyrazoline, 1-phenyl-3-(p-diethylaminostyryl)-4-methyl-5-(p-diethylaminophenyl)pyrazoline, 1-phenyl-3-(α-benzyl-p-diethylaminostyryl)-5-(p-diethylaminophenyl)pyrazoline, spiropyrazoline, etc.; oxazole type compounds such as 2-(p-diethylaminostyryl)-6-diethylaminobenzoxazole, 2-(p-diethylaminophenyl)-4-(p-dimethylaminophenyl)-5-(2-chlorophenyl)oxazole, etc.; thiazole type compounds such as 2-(p-diethylaminostyryl)-6-diethylaminobenzthiazole, etc.; triarylmethane type compounds such as bis(4-diethylamino-2-methylphenyl)phenylmethane, etc.; polyarylalkanes such as 1,1-bis(4-N,N-diethylamino-2-methylphenyl)heptane, 1,1,2,2-tetrakis(4-N,N-diethylamino-2-methylphenyl)ethane, etc.; stilbene compounds such as 5-(4-diphenylaminobenzylidene)-5H dibenzo[a,d]cycloheptene, 1,2-benzo-3-(d-phenylstyryl)-9-n-butylcarbazole, etc.

The method for preparing the electrophotographic photosensitive member of the present invention is described below by referring to an example of the case of the function separation type photosensitive member in which a charge transport layer is laminated on a charge generation layer.

The above charge generating substance is well dispersed together with a 0.3 to 10-fold amount of a binder resin and solvent according to the method by means of homogenizer, sonication, ball mill, vibrating ball mill, sand mill, attritor, roll mill, etc. The dispersion is applied on the above substrate coated with a subbing layer and dried to form a coating with a thickness of 0.1 to 1μ.

In this example, the surface layer is a charge transport layer and therefore fluorine type resin powder is dispersed herein.

That is, a binder resin, fluorine type resin powder and a fluorine type graft polymer are dispersed together with a solvent by a homogenizer, a sonication, ball mill, sand mill, attritor, roll mill, etc., and a solution of the charge transporting substance and a binder resin is added to the dispersion to make up a desired charge transport layer solution. The fluorine type graft polymer may be added during dispersion of the fluorine type resin powder to give the best effect in contributing to stability of the fluorine type resin powder. However, the fluorine type resin powder may be previously dispersed, followed by addition of the fluorine type graft polymer.

The mixing ratio of the charge transporting substance and the binder resin may be about 2:1 to 1:4.

As the solvent, aromatic hydrocarbons such as toluene, xylene, etc., chlorine type hydrocarbons such as dichloromethane, chlorobenzene, chloroform, carbon tetrachloride, etc., may be used. This solution may be coated according to, for example, dip coating, spray coating, spinner coating, bead coating, blade coating, curtain coating and other coating methods, and drying can be conducted at 10° to 200° C., preferably 20° to 150° C., for 5 minutes to 5 hours, preferably for 10 minutes to 2 hours, either under air stream or stationary conditions. The charge transport layer formed has a film thickness of about 10 to 30μ.

On the other hand, in the case of a photosensitive member having a charge generation layer provided by coating on a charge transport layer, the charge generation layer becomes the surface layer and therefore the fluorine resin powder stabilized in dispersion with the fluorine type graft polymer is contained herein. The charge generation layer dispersion can be prepared by adding and mixing a dispersion having the fluorine type resin powder dispersed in a binder resin to be used for the charge generation layer with the use of the fluorine type graft polymer as the dispersing agent into a dispersion of the charge generating substance prepared as described above, and a photosensitive member of the present invention can be obtained by applying the dispersion on the charge transport layer.

When the photosensitive layer has a protective layer, the protective layer becomes the surface layer of the photosensitive member and the fluorine type resin powder is stabilized in dispersion with the fluorine type graft polymer is contained in this protective layer. This protective layer can be obtained by applying a dispersion of the fluorine type resin powder stabilized in dispersion with the fluorine type graft polymer in a resin for forming the protective layer on the photosensitive layer.

According to the present invention, since the electrophotographic photosensitive member containing fluorine type resin powder and fluorine type graft polymer contains the fluorine type resin powder dispersed uniformly to be improved in its dispersion stability, a constantly uniform surface layer can be obtained to give the results that no damage or image flow will be generated in the initial image as a matter of course and even after repeated successive copying, whereby images of high quality can be always obtained.

The present invention is described in more detail by referring to Examples.

[EXAMPLES]

Synthesis of fluorine type graft polymers (A-1 and A-2)

Fluorine type graft polymers were synthesized on the basis of the macromer synthetic method disclosed in Japanese Laid-open Patent Publication No. 164656/1983 in which the terminal double bond is introduced with glycidyl methacrylate by use of thioglycolic acid as the chain transfer agent. When this macromer is a non-fluorine type segment, copolymerization with a fluorine type polymerizable monomer was conducted, while when the macromer is fluorine type segment, copolymerization with a non-fluorine type polymerizable monomer was conducted to synthesize a fluorine type graft polymer.

(i) Fluorine type graft polymer No. 1 a. Synthesis of terminal methacrylate type methyl methacrylate macromer

A glass flask equipped with an agitator, a reflux condenser, a dropping funnel, thermometer and a gas blowing inlet was charged with 10 parts of methyl methacrylate (hereinafter abbreviated as MMA) and 90 parts of a solvent mixture of acetone (17.5%)toluene and, after introduction of $N_2$, polymerization was initiated under reflux by adding 0.5 parts of azobisisobutylonitrile (hereinafter abbreviated as AIBN) as the polymerization initiator and 0.35 parts of thioglycolic acid as the chain transfer agent. Then, within 5 hours, 90 parts of MMA were added dropwise continuously, and a solution of 2.9 parts of thioglycolic acid dissolved in 10 parts of toluene was added in 9 divided portions every 30 minutes, and similarly 1.5 parts of AIBN was added similarly in 4 divided portions every one hour to carry out polymerization. Further, the mixture was thereafter refluxed for 2 hours to complete polymerization and give a polymer solution of the following structural formula [I]. The reaction temperature was 77 to 87° C. A part of the reaction mixture was reprecipitated with n-hexane and dried. The acid value of the polymer was measured to b 0.350 mg equivalent/g.

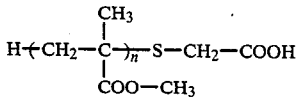

[I]

Next, after a part of acetone was evaporated from the above reaction mixture, 0.5 % of triethylamine as the catalyst and 250 ppm of hydroquinone monomethyl ether as the polymerization inhibitor were added, and a glycidyl methacrylate in an amount of 1.2-fold mols relative to the acid value was added, followed by the reaction under reflux (about 110° C.) for 12 hours. The conversion determined from reduction in acid value was 96 %. The reaction mixture was thrown into 10-fold amount of n-hexane to be precipitated, and then dried under reduced pressure at 80° C. to give 85 parts of a macromonomer of the following structural formula [II]. Molecular weights calculated on polystyrene by gel permeation chromatography (hereinafter called GPC) were found to be 2780 (number average) and 6350 (weight average).

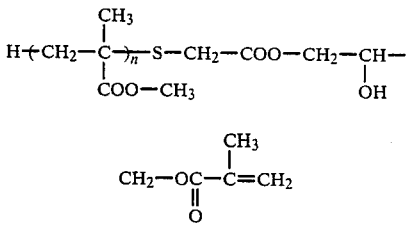

[II]

b. Synthesis of fluoroalkyl acrylate (trunk)/methyl mechacrylate (branch)-graft polymer The same device as in a was charged with 70 parts of the macromonomer of the above structural formula [II], 30 parts of a fluoroalkyl acrylate of the following structural formula [III], 300 parts of trifluorotoluene ($C_6H_5CF_3$) and 0.35 parts of AIBN, and after introduction of $N_2$, the reaction was carried out under reflux (about 100° C) for 5 hours.

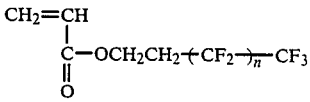

[III]

(mixture of n=4-12; average value of n is about 7)

The reaction mixture was thrown into 10-fold amount of methanol to be precipitated and dried under reduced pressure at 80° C. to obtain 65 parts of a graft polymer.

This polymer exhibited a single peak by GPC and the molecular weights calculated on polystyrene were found to be 18500 (number average) and 29400 (weight average).

Also, with addition of trifluorotoluene as the internal standard substance, $^1$H-NMR spectrum was measured in $CDCl_3$ solvent, and the content of MMA units in the graft polymer was determined from the peak area ratio of H in trifluorotoluene to —O—$CH_3$ in the MMA unit in the polymer to be 60%. The remaining 40% was attributed to fluoroalkyl acrylate. Thus, a fluorine type graft polymer with a content of the fluorine type segment of 40% was obtained.

(ii) Fluorine type graft polymer No. 2, 3

By changing the amount of fluoroalkyl acrylate charged, following otherwise the same operation as in the above (i), fluorine type graft polymers with fluorine type segment contents of 21% (No. 2) and 61% (No. 3), having molecular weights of 24,000 and 18,000 (number average), respectively, were synthesized.

(iii) Fluorine type graft polymer NO. 4

By use of the same device and the operation as in the above (i) except for changing methyl methacrylate to styrene, fluoroalkyl acrylate to 2,3,5,6-tetrafluorophenylmethacrylamide of the following structural formula [IV](the amount charged was controlled to the same concentration of double bonds), a fluorine type graft polymer with a fluorine type segment content of 25% and a number average molecular weight of 36,000 was synthesized. The molecular weight of the styrene macromer was 7000.

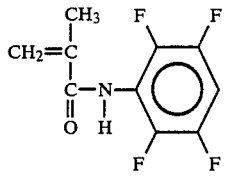

[IV]

(iv) Fluorine type graft polymer No. 5

Under the same reaction conditions as in the above (i)-a except for changing methyl methacrylate to the fluoroalkyl acrylate in (i)-b, a fluorine type macromer with a number average molecular weight of 6600 was synthesized. Further, under the same conditions as in (i)-b except for using methyl methyacrylate in place of the fluoroalkyl acrylate in the above (i)-b, a fluorine type graft polymer comprising a branch of a fluorine type segment was synthesized.

The content of the fluorine type segment was 25%, and the number average molecular weight was 42000.

(v) Fluorine type graft polymer No. 6

According to the same procedure as in (i)-a except for using 2.4 parts of 2-mercaptoethanol in place of thioglycolic acid, a polymer solution of the following formula [V]was obtained.

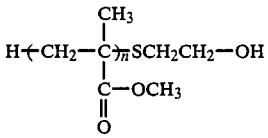

[V]

Further, glycidyl methacrylate was reacted with the polymer in the same manner as in (i)-a to synthesize a macromer. The molecular weights calculated on polystyrene by GPC were found to be 3250 (number average) and 7800 (weight average).

Next, in the same manner as in (i)-b, a graft polymer comprising a trunk of the fluoroalkyl acrylate and a branch of methyl methacrylate was synthesized.

The fluorine type segment content was 30%, and the number average molecular weight was 32000.

(vi) Fluorine type graft polymer No. 7

According to the same procedure as in (i)-a except for using 2.4 parts of 2-aminoethylmercaptan in place of thioglycolic acid and styrene in place of methyl methacrylate, a polymer solution of the following structural formula [VI]was obtained.

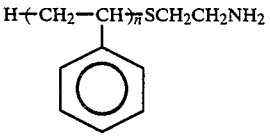

[VI]

Further, glycidyl methacrylate was reacted with the polymer in the same manner as in (i)-a to synthesize a macromer. The molecular weights calculated on polystyrene by GPC were found to be 3450 (number average) and 7700 (weight average).

Next, in the same manner as in (i)-b, a graft polymer comprising a trunk of the fluoroalkyl acrylate and a branch of methyl methacrylate was synthesized. The fluorine type segment content was 32%, and the average molecular weight was 46,000.

Synthesis of fluorine type graft polymer (B-1 and B-2)

Fluorine type graft polymers were synthesized on the basis of the macromer synthetic method disclosed in Japanese Laid-open Patent Publication No. 164656/1983 or the macromer synthetic method disclosed in U.S. Pat. No. 3,689,593 in which terminal double bonds are introduced with tolylene diisocyanate and 2-hydroxyethyl methacrylate by use of 2-mercaptoethanol as the chain transfer agent.

When this macromer was a non-fluorine type segment, copolymerization with a fluorine type monomer was conducted, while when the macromer was a fluorine type segment, copolymerization with a non-fluorine type polymerizable monomer was conducted to obtain a fluorine type graft polymer.

(vii) Fluorine type graft polymer No. 8 a. Synthesis of terminal methacrylate type methyl methacrylate macromer

A glass flask equipped with an agitator, a reflux condenser, a dropping funnel, thermometer and a gas blowing inlet was charged with 10 parts of MMA and 85 parts of a solvent mixture of acetone (17.5%)toluene and, after introduction of $N_2$, polymerization was initiated under reflux by adding 0.5 parts of AIBN as the polymerization initiator and 0.27 parts of 2-mercaptoethanol as the chain transfer agent. Then, within 5 hours, 90 parts of MMA were added dropwise continuously, and a solution of 2.4 parts of 2-mercaptoethanol dissolved in 8 parts of toluene was added in 9 divided portions every 30 minutes, and similarly 1.5 parts of AIBN was added similarly in divided portions every 1.5 hours to carry out polymerization. Further the mixture was thereafter refluxed for 2 hours to complete polymerization and give a polymer solution of the above structural formula [V]. The reaction temperature was 78° to 88° C.

Next, to the above polymer solution were added 6.0 parts of 2,4-tolylenediisocyanate and 0.35 parts of dibutyl tin dilaurate, and the reaction was carried out at 78° to 82° C. for 30 minutes to obtain an isocyanate terminated polymer solution of the following structural formula [VII].

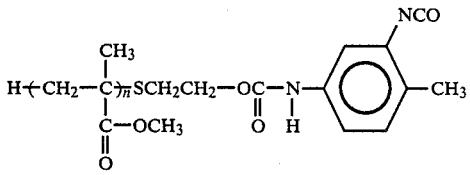

[VII]

Further, with addition of 4.45 parts of 2-hydroxyethyl methacrylate, the reaction was carried out at 78° to 82° C. for 60 minutes. Then, the reaction mixture was thrown into 10-fold amount of n-hexane to be precipitated, followed by drying under reduced pressure at 80° C. to obtain 94 parts of a macromer of the following structural formula [VIII]:

[VIII]

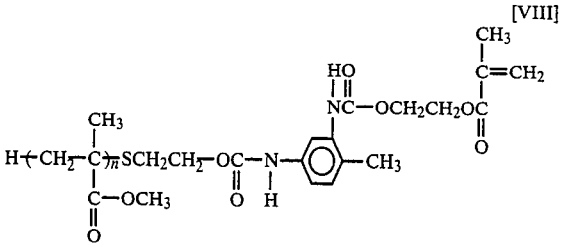

units in the graft polymer was determined from the peak area ratio of H in trifluorotoluene and H in —O—$CH_3$ in MMA units of the polymer to be 72%. The remaining 28% was attributed to the fluoroalkyl acrylate. Thus, a fluorine type graft polymer No. 8 with a fluorine type segment content of 28% was obtained.

(ii) Other fluorine type graft polymers

By use of the starting materials shown in Table 1, various fluorine type graft polymers were synthesized according to the same synthetic method as described above.

TABLE 1

Various fluorine type graft polymers

| | Macromer constituents | | | | | | Fluorine type graft polymer properties | |
|---|---|---|---|---|---|---|---|---|
| No. | Vinyl monomer | Chain transfer agent | Isocyanate compound | Vinyl terminated monomer | Number average molecular weight | Trunk segment Vinyl monomer constituting trunk segment | Number average molecular weight | Fluorine type segment content |
| 9 | Styrene | 2-mercapto-aminoethane | 1,6-hexa-methylene-diisocyanate | 2-hydroxy-ethyl-methacrylate | 2130 | Fluoroalkyl acrylate (the same as No. 1) | 44200 | 22 wt. % |
| 10 | Methyl-methacrylate/ styrene (weight ratio: 20/80) | 3-mercapto-propionic acid | 2.4. TDI | Methacrylic acid | 3170 | 2,3,5,6-tetrachlorophenyl methacrylate*1 | 60800 | 10 wt. % |
| 11 | Styrene | 2-mercapto-ethanol | 4,4-diphenyl-methane-diisocyanate | 2-aminoethyl methacrylate | 6620 | Fluoroalkyl acrylamide *2 | 84600 | 28 wt. % |
| 12 | Fluoroalkyl-acrylate | 2-mercapto-ethanol | 4,4-dicyclo-hexylmethane-diisocyanate | 2-aminoethyl methacrylate | 3920 | Styrene | 57300 | 15 wt. % |
| 13 | Fluoroalkyl-acrylate | 3-mercapto-propionic acid | isophorone-diisocyanate | 3-hydroxy-propyl-methacrylate | 1860 | Methyl methacrylate | 19400 | 43 wt. % |

*1

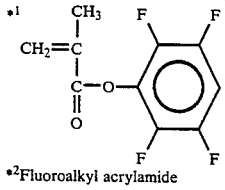

*2Fluoroalkyl acrylamide

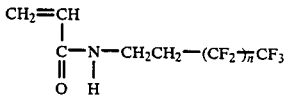

(n: mixture of 4–12, average of n: about 7)

The molecular weights calculated on polystyrene by GPC were found to be 3040 (number average) and (weight average).

b. Synthesis of graft polymer of fluoroalkyl acrylate (trunk)/methyl methacrylate (branch)

The same device as in a was charged with 70 parts of the macromer of the above formula [VIII], 30 parts of a fluoroalkyl acrylate of the above formula III], 300 parts of trifluorotoluene ($C_6H_5CF_3$) and 0.35 parts of AIBN and, after introduction of $N_2$, the reaction was carried out under reflux (about 100° C.) for 5 hours.

The reaction mixture was thrown into 10-fold amount of methanol to be reprecipitated, followed by drying under reduced pressure at 80° C. to obtain 62 parts of a graft polymer.

This polymer exhibited at single peak by GPC, and the molecular weights calculated on polystyrene were found to be 20500 (number average) and 32000 (weight average). Also, with addition of trifluorotoluene as the internal standard substance, $^1$H-NMR spectrum was measured in $CDCl_3$solvent, and the content of MMA Synthesis of fluorine type graft polymer (C-1)

Fluorine type graft polymers were synthesized on the basis of the macromer synthetic method according to the anion polymerization method disclosed in U.S. Pat. No. 3,786,116 or U.S. Pat. No. 3,928,255 in which a compound having unsaturated double bond is used as the stopping agent. By copolymerization of these macromers with a fluorine type polymerizable monomer, fluorine type graft polymers can be obtained.

(viii) Fluorine type graft polymer No. 14 a. Synthesis of vinyl terminated styrene macromer

A stainless steel reactor was charged with 80 parts of dehydrated benzene, which was raised in temperature to 40° C. and one drop of diphenylethylene was added thereto. With addition of 30 ml of 12% pentane solution of t-butyllithium and further 321 parts of styrene, the reaction was carried out at 40° C. for 30 minutes. Next, 8 ml of vinyl-2-chloroethyl ether was added to stop the reaction. The reaction mixture was added dropwise into methanol to reprecipitate the polymer. The polymer was separated by filtration and dried under reduced pressure at 80° C. to obtain a styrene macromer of the following formula [IX].

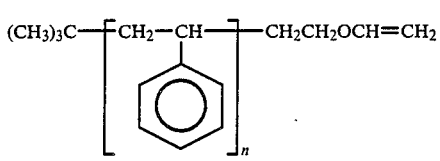

[IX]

The molecular weights calculated on polystyrene by GPC was 6400 (number average).

b. Synthesis of a graft polymer of fluoroacrylate (trunk)/styrene (branch)

A glass flask equipped with an agitator, a reflux condenser, a dropping funnel, a thermometer and a gas blowing inlet was charged with 70 parts of the styrene macromer of the above structural formula [IX], 30 parts of the fluoroacrylate of the above structural formula [III], 280 parts of trifluorotoluene ($C_6H_5CF_3$), and 0.35 parts of AIBN, and after introduction of $N_2$, the reaction was carried out under reflux (about 100° C.) for 5 hours.

The reaction mixture was thrown into 10-fold amount of methanol to be reprecipitated, followed by drying under reduced pressure at 80° C. to obtain a graft polymer. This polymer was found to have a number average molecular weight of 48,300 as measured by GPC.

Also, with addition of trifluorotoluene as the internal standards substance, $^1$H-NMR spectrum was measured in $CDCl_3$ solvent, and the content of units in the graft polymer was determined from the peak area ratio of H in trifluorotoluene to the aromatic ring H in styrene units in the polymer to be 72%. The remaining 28% was attributed to the fluoroalkyl acrylate. Thus, fluorine type graft polymer number 14 with a content of the fluorine type segment of 28% was obtained.

(ii) Other fluorine type graft polymers

By use of the starting materials shown in Table 2, various fluorine type graft polymers were synthesized according to the same synthetic method as described above.

TABLE 2

| | Various fluorine graft polymer | | | | | |
|---|---|---|---|---|---|---|
| | Macromer constituent | | | Fluorine type vinyl monomer | Fluorine type graft polymer properties | |
| No. | Vinyl monomer | Stopping agent | Number average molecular weight | constituting trunk segment | Number average molecular weight | Fluorine type segment content |
| 15 | α-methyl-styrene | $CH_2{=}CHOCH_2CH_2Cl$ | 4370 | Fluoroalkyl acrylate | 56300 | 24 wt % |
| 16 | α-cyanoethyl acrylate | $CH_2{=}C(CH_3)C(=O)Cl$ | 6480 | Fluoroalkyl acrylate (the same as No. 1) | 72500 | 41 |
| 17 | Styrene | $CH_2{=}CH{-}C_6H_4{-}CH_2CH_2Cl$ | 2410 | 2,3,5,6-tetra*1 chlorophenyl methacrylate | 28600 | 18 |
| 18 | α-methyl-styrene | $CH_2{=}CH{-}OC(=O){-}CH_2CH_2Cl$ | 3850 | Fluoroalkyl*2 acrylamide | 49400 | 12 |
| 19 | Methyl methacrylate | $CH_2{-}CH_2$ (O) / $CH_2{=}CHC(=O)Cl$ | 2870 | Fluoroalkyl*3 vinyl ether | 38600 | 37 |

*1

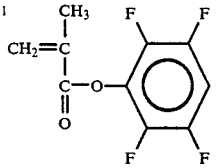

*2 $CH_2{=}CH{-}C(=O){-}N(H){-}CH_2CH_2{-}(CF_2)_n{-}CF_3$ n: mixture of 4–12

*3 $CH_2{=}CH{-}O{-}CH_2CH_2{-}(CF_2)_n{-}CF_3$ n: mixture of 4–12 (average of n = 7)

EXAMPLE 1

A substrate of aluminum cylinder with 80 mm diameter and 300 mm length was coated by dipping with a 5% methanolic solution of a polyamide (trade name, Amilane CM-4000, produced by Toray K.K.) to provide a subbing layer with a thickness of 1μ.

Next, 10 parts (parts by weight, hereinafter the same) of a disazo pigment having the following structural formula:

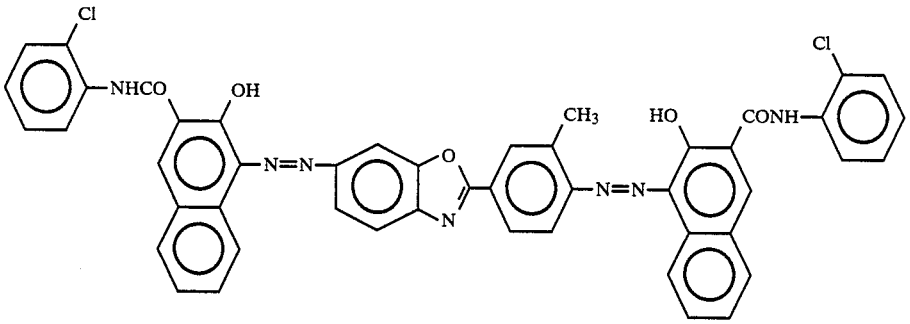

5 parts of polyvinylbutyral (tradename S-Lec BM-2, produced by Sekisui Kagaku K.K.) and 50 parts of cyclohexanone were dispersed in sand mill by use of glass beads of 1 mm diameter for 20 hours. To this dispersion were added 70 to 120 (as desired) parts of methyl ethyl ketone, and the dispersion was applied on the subbing layer to form a charge generation layer with a thickness of 0.20μ.

Next, 10 parts of a polymethyl methacrylate (trade name: Dianal BR-85, produced by Mitsubishi Rayon K.K.), 10 parts of a polytetrafluoroethylene (trade name: Lubron L-2, produced by Daikin Kogyo K.K.) and 0.5 parts of the above No. 1 fluorine type graft polymer were dissolved in 40 parts of monochlorobenzene and 30 parts of tetrahydrofuran, and the mixture was dispersed in a stainless steel ball mill for 48 hours. With 10 parts of the dispersion obtained were mixed 70 parts of a resin solution containing 10 parts of a hydrazone compound having the structural formula shown below:

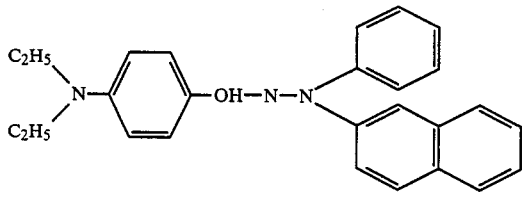

and 10 parts of the above polymethyl methacrylate dissolved in 60 parts of monochlorobenzene to prepare a charge transport layer solution. Also, by use of the fluorine type graft polymers of Nos. 8 and 14, charge transport layer solutions were prepared similarly. The mean particle sizes of the polytetrafluoroethylene powder in the charge transport layer solutions were measured to be 0.45μ, 0.46μ and 0.48μ, respectively by a particle size distribution measuring machine (CAPA-500, produced by Horiba Seisakusho).

Each of these solutions was applied on the above charge generation layer, followed by drying in hot air at 110° C. for 90 minutes to form a charge transport layer with a thickness of 18μ. These are called samples 1, 2 and 3, respectively. The surface of the charge transport layer obtained was found to be uniform and smooth. The average surface roughness of this surface layer was 0.2μ or less, which was equal to the average surface roughness of the charge transport layer surface formed of a charge transport material containing no fluorine type resin powder and a binder resin.

For comparison, by use of a material in which no fluorine type graft polymer was added, a photosensitive member was prepared in the same manner as described above. This is called comparative sample 4.

The comparative sample 4 exhibited excessive agglomeration of the polytetrafluoroethylene powder in the surface layer to give a state which is unsatisfactory for evaluating images.

On the other hand, a photosensitive member in which no polytetrafluoroethylene and fluorine type graft polymer was added was prepared in the same manner as described above. This is called comparative sample 5.

For these respective samples, successive copying characteristic of 30,000 sheets was evaluated by an electrophotographic process comprising −5.5 KV corona charging, image exposure, dry toner development, transfer onto plane paper, cleaning with silicon rubber cleaning roller, urethane rubber blade and pre-exposure. The results are shown in Table 3.

TABLE 3

| | Fluorine type graft polymer No. | Initial image | Successive copying at 23° C., 55% RH | Successive copying at 32.5° C., 90% RH |
|---|---|---|---|---|
| Sample 1 | 1 | Good | Stable image of high quality up to 30000 sheets | Stable image of high quality up to 30000 sheets |
| Sample 2 | 8 | Good | Stable image of high quality up to 30000 sheets | Stable image of high quality up to 30000 sheets |
| Sample 3 | 14 | Good | Stable image of high quality up to 30000 sheets | Stable image of high quality up to 30000 sheets |
| Comparative | — | Black dots | Not worthwhile succes- | Not worthwhile succes- |

TABLE 3-continued

| | Fluorine type graft polymer No. | Initial image | Successive copying at 23° C., 55% RH | Successive copying at 32.5° C., 90% RH |
|---|---|---|---|---|
| sample 4 | | on whole surface | sive copying | sive copying |
| Comparative sample 5 | — | Good | Friction damage after 10000 sheets, toner fusion on the surface after 20000 sheets | Image flow generated after 8000 sheets |

EXAMPLE 2

A substrate of aluminum cylinder with 80 mm diameter and 300 mm length was coated by dipping with a 5% methanolic solution of a polyamide (trade name, Amilane CM-4000, produced by Toray K.K.) to provide a subbing layer with a thickness of 1μ.

Next, a charge generation layer was formed with the same material and according to the same method as in Example 1.

Next, 10 parts of a bisphenol Z type polycarbonate (produced by Mitsubishi Gas Kagaku K.K.), 20 parts of a polyvinylidene fluoride (trade name Kynar K-301F, produced by Penwald Co.) and 3 parts of the above fluorine type graft polymer of No. 4 were dissolved in 50 parts of cyclohexanone and 20 parts of tetrahydrofuran, and the mixture was dispersed in a sand mill device by use of 1 mm diameter glass beam for 20 hours. With 10 parts of the resultant dispersion were mixed 70 parts of a resin solution containing 12 parts of a pyrazoline compound of the following structural formula:

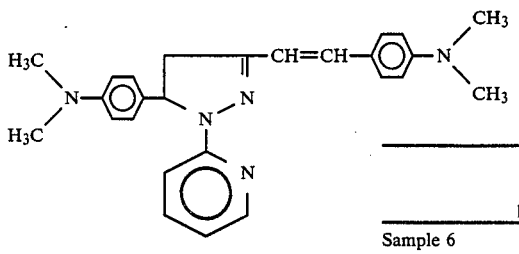

and 10 parts of the above polycarbonate resin dissolved in 40 parts of cyclohexanone and 20 parts of tetrahydrofuran to prepare a charge transport layer solution. Also, by use of the fluorine type graft polymers of No. 9 and 15, charge transport layer solutions were prepared similarly as described above, respectively. The mean particle sizes of the polyvinylidene fluoride were found to be 0.42μ, 0.45μ and 0.48μ, respectively. Each of these solutions was applied on the above charge generation layer, followed by drying in hot air at 110° C. for 90 minutes to form a charge transport layer with a thickness of 20μ. These are called samples 6, and 8. The surface roughness was found to be 0.2μ or less.

For comparison, a photosensitive member was prepared in the same manner as described above by use of a material containing no fluorine type graft polymer added. This is called comparative sample 9.

The comparative sample 9 exhibited excessive agglomeration of the polyvinylidene fluoride powder in the surface layer to give a state which is unsatisfactory for evaluating images.

On the other hand, a photosensitive member was prepared in the same manner as described above by use of a material containing no polyvinylidene fluoride and no fluorine type graft polymer added. This is called comparative sample 10.

For these respective samples, successive copying characteristics of 30,000 sheets were evaluated by an electrophotographic process comprising −5.5 KV corona charging, image exposure, dry process toner development, transfer onto plane paper, cleaning with urethane rubber blade and silicon rubber cleaning roller and pre-exposure. The results are shown in Table 4.

TABLE 4

| | Fluorine type graft polymer No. | Initial image | Successive copying at 23° C., 55% RH | Successive copying at 32.5° C., 90% RH |
|---|---|---|---|---|
| Sample 6 | 4 | Good | Stable image of high quality up to 30000 sheets | Stable image of high quality up to 30000 sheets |
| Sample 7 | 9 | Good | Stable image of high quality up to 30000 sheets | Stable image of high quality up to 30000 sheets |
| Sample 8 | 15 | Good | Stable image of high quality up to 30000 sheets | Stable image of high quality up to 30000 sheets |
| Comparative sample 9 | — | Black dots on whole surface | Not worthwhile evaluation | Not worthwhile evaluation |
| Comparative sample 10 | — | Good | Toner fusion after 6000 sheets | Image flow generated after 5000 sheets |

EXAMPLE 3

10 parts of the hydrazone compound used in Example 1 and 10 parts of a styrene-methyl methacrylate copolymer (trade name: Estyrene MS-200, produced by Shinnippon Seitetsu K.K.) were dissolved in 60 parts of monochlorobenzene. This solution was applied by coating on the aluminum cylinder of 80 mm diameter×300 mm length coated with a subbing layer similarly as in Example 1, followed by drying at 100° C. for 1 hour to form a charge transport layer of 12 μ.

Next, 10 parts of a disazo pigment of the following structural formula:

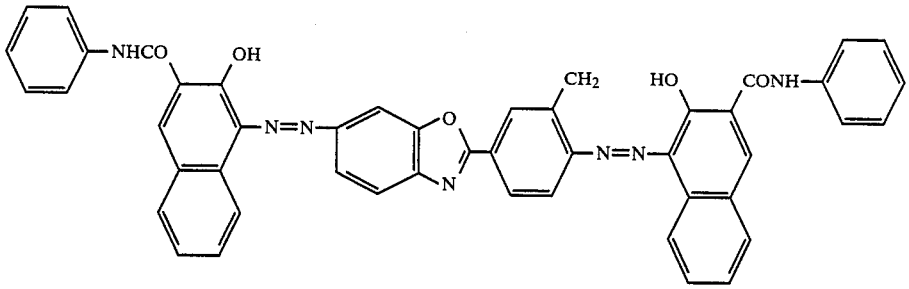

5 parts of a polytrifluorochloroethylene powder (produced by Daikin Kogyo K.K.) and 1 part of the above fluorine type graft polymer of NO. 2 were added into 100 parts of a 10 wt.% cyclohexanone solution of the above styrene/methyl methacrylate copolymer and dispersed in a stainless steel ball mill for 50 hours. This solution was thrust coated on the above charge transport layer, followed by drying at 100° C. for 20 minutes to form a charge generation layer with a thickness of 2μ. Also, by use of the fluorine type graft polymer of Nos. 10 and 16, charge generation layers were formed in the same manner as described above, respectively. The mean particle sizes of the polytrifluorochloroethylene powder in the charge generation layer solution were found to be 0.52μ, 0.50μ and 0.54μ, respectively. The photosensitive members prepared are called samples 11, 12 and 13. The surface roughness for each sample was 0.2μ or less.

For comparison, by use of a material containing no fluorine type graft polymer added, a photosensitive member was prepared in the same manner as described above. This is called comparative sample 14.

The comparative sample 14 exhibited excessive agglomeration of the polytrifluorochloroethylene powder in the surface layer to give a state unsatisfactory for evaluating images.

On the other hand, by use of a material containing no polytrifluorochloroethylene and no fluorine type graft polymer added, a photosensitive member was prepared in the same manner as described above. This is called comparative sample 15. Each of these samples was mounted on an electrophotographic copying machine having the steps of +5.6 KV corona charging, image exposure, drying process toner development, transfer onto plain paper, cleaning with urethane rubber blade and pre-exposure and successive copying characteristic of 10,000 sheets was evaluated. The results are shown in Table 5.

TABLE 5

| | Fluorine type graft polymer No. | Initial image | Successive copying at 23° C., 55% RH | Successive copying at 32.5° C., 90% RH |
|---|---|---|---|---|
| Sample 11 | 2 | Good | Stable image of high quality up to 10000 sheets | Stable image of high quality up to 10000 sheets |
| Sample 12 | 10 | Good | Stable image of high quality up to 10000 sheets | Stable image of high quality up to 10000 sheets |
| Sample 13 | 16 | Good | Stable image of high quality up to 10000 sheets | Stable image of high quality up to 10000 sheets |
| Comparative sample 14 | — | Black dots on whole surface | Not worthwhile evaluation | Not worthwhile evaluation |
| Comparative sample 15 | — | Good | Friction damage after 3000 sheets | Image flow generated after 2000 sheets |

EXAMPLE 4

One part of aluminum chloride phthalocyanine, 10 parts of a polysulfone resin (trade name: Udel Polysulfone P-3500, produced by Nissan Kagaku K.K.), 7 parts of polytetrafluoroethylene-hexafluoropropylene copolymer powder (produced by Daikin Kogyo K.K.) and 2 parts of the above fluorine type graft polymer of No. 3 were dispersed together with 40 parts of monochlorobenzene and 10 parts of tetrahydrofuran in a sand mill by use of 1 mm diameter glass beads for 20 hours, and to the resultant dispersion were added 6 parts of the pyrazoline compound used in Example 2. Also, by use of the fluorine type graft polymers of Nos. 11 and 17, solutions were prepared similarly as described above. The mean particle sizes of the polytetrafluoroethylene-hexafluoropropylene copolymer powders in these solutions were found to be 0.38μ, 0.46μ and 0.48μ, respectively. Each of these solutions was applied by coating on the 80 mm diameter×300 mm length aluminum cylinder coated with the subbing layer similarly as in Example 2 to provide a photosensitive layer of 14μ. The surface roughness was found to be 0.2μ or less. The photosensitive members prepared are called samples 16, 17 and 18, respectively.

For comparison, by use of a material containing no fluorine type graft polymer added, a photosensitive member was prepared similarly as described above. This is called comparative sample 19. The comparative sample 19 exhibited excessive agglomeration of the polytetrafluoroethylene-hexafluoropropylene copolymer powder in the surface layer to give a state unsatisfactory for evaluating images.

On the other hand, by use of a material containing no polytetrafluoroethylene-hexafluoropropylene copolymer and no fluorine type graft polymer, a photosensitive member was prepared similarly as described above. This is called comparative sample 20.

For these respective samples, successive copying characteristics of 10,000 sheets were evaluated by an electrophotographic process comprising −5.5 KV corona charging, image exposure, dry type toner development, transfer onto plain paper, cleaning with urethane rubber blade and pre-exposure. The results are shown in Table 6.

TABLE 5

| | Fluorine type graft polymer No. | Initial image | Successive copying at 23° C., 55% RH | Successive copying at 32.5° C., 90% RH |
|---|---|---|---|---|
| Sample 16 | 3 | Good | Stable image of high quality up to 10000 sheets | Stable image of high quality up to 10000 sheets |
| Sample 17 | 11 | Good | Stable image of high quality up to 10000 sheets | Stable image of high quality up to 10000 sheets |
| Sample 18 | 17 | Good | Stable image of high quality up to 10000 sheets | Stable image of high quality up to 10000 sheets |
| Comparative sample 19 | — | Black dots on whole surface | Not worthwhile evaluation | Not worthwhile evaluation |
| Comparative sample 20 | — | Good | Toner fusion after 2000 sheets | Image flow generated after 1500 sheets |

EXAMPLE 5

By use of 10 parts of the bisphenol Z type polycarbonate used in Example 2, 20 parts of a polyvinyl fluoride (produced by Daikin Kogyo K.K.) and 3 parts of the above fluorine type graft polymer of No. 5, a dispersion was prepared in the same manner as in Example 2. With 90 parts of the resultant dispersion were mixed 70 parts of a resin solution containing 20 parts of the above polycarbonate resin dissolved in 40 parts of cyclohexanone and 20 parts of THF to prepare a protective layer solution. Also, by use of the fluorine type graft polymers of Nos. 12 and 18, protective layer solutions were prepared similarly as described above. The mean particle sizes of the polyvinyl fluoride powder in these solutions were found to be 0.45μ, 0.47μ and 0.48μ, respectively. Each of these protective layer solutions was thrust coated on the surface layer of the comparative sample 10 prepared in Example 2, followed by drying in hot air at 100° C. for 30 minutes to form a protective layer of 3μ. The surface roughness was found to be 0.2μ or less. These are called samples 21, 22 and 23, respectively. Each of these samples was subjected to successive copying tests of 30,000 sheets similarly as described in Example 2. As the result, stable images of high quality were obtained up to 30,000 sheets both under the conditions of 23° C. and 55% RH and 32.5° C. and 90% RH .

EXAMPLE 6

A solutions of 6 parts of a polymethyl methacrylate (trade name: Dianal BR-85, produced by Mitsubishi Rayon K.K.), 10 parts of a difluorochloroethylene (produced by Daikin Kogyo K.K.) and 0.5 parts of the above fluorine type graft polymer of No. 6 dissolved in 40 parts of monochlorobenzene and 30 parts of tetrahydrofuran was dispersed in a stainless steel ball mill for 48 hours in the resultant dispersion and 6 parts of the hydrazone compound used in Example 1 was dissolved in the resulting dispersion to prepare a charge transport layer solution. The charge transport layer solution was applied on the charge generation layer prepared in the same manner as in Example 1 to prepare an electrophotographic photosensitive member. The mean particle size of the polydifluorochloroethylene powder in the charge transport layer solution was found to be 0.48μ, and the charge transport layer surface obtained was found to be uniform and smooth, with the average surface roughness being 0.2μ or less. This is called sample 24. When this sample was subjected to successive copying test of 30,000 sheets similarly as in Example 1, stable images of high quality were obtained up to 30,000 sheets both under the conditions of 23° C. and 55% RH, 32.5° C. and 90% RH.

EXAMPLE 7

An electrophotographic photosensitive member was prepared according to entirely the same procedure as in Example 2 except for using the fluorine type graft polymer of No. 7 in place of the fluorine type graft polymer No. 4 and a vinylidene fluoride-hexafluoro propylene copolymer in place of the polyvinylidene fluoride. The mean particle size of the vinylidene fluoride-hexafluoropropylene copolymer powder in the charge transport layer solution was found to be 0.49μ, and the charge transport layer surface obtained was uniform and smooth, with the surface roughness being 0.2μ or less. This is called sample 25. When this sample was subjected to successive copying test of 30,000 sheets similarly as in Example 2, stable images of high quality were obtained up to 30,000 sheets both under the conditions of 23° C., 55% RH and 32.5° C., 90% RH.

Next, by use of the same material, charge transport solutions with contents of the vinylidene fluoride-hexafluoropropylene copolymer of 0.5 wt. % and 60 wt. % were prepared and electrophotographic photosensitive members were prepared similarly as described above and successive copying evaluations were conducted. As the result, for the sample containing 0.5 wt. % of the vinylidene fluoride-hexafluoropropylene copolymer, toner fusion was generated at a successive copying of 6,500 sheets under the conditions of 23° C. and 55% RH, and image flow was generated after successive copying of 5,000 sheets under the conditions of 32.5° C. and 90% RH. On the other hand, for the sample containing 60 wt. % of the copolymer, no toner fusion or image flow was generated after 30,000 sheets under both environments, but black fog accompanied with increase of the light portion potential by lowering the mobility of carriers was generated after about 10,000 sheets.

What is claimed is:

1. An electrophotographic photosensitive member having a photosensitive layer on an electroconductive substrate, which includes a surface layer containing a binder, a fluorine type resin powder and a fluorine type graft polymer.

2. An electrophotographic photosensitive member according to claim 1, wherein said fluorine type resin powder is selected from the group consisting of tetrafluoroethylene resins, trifluorochloroethylene resins, tetrafluoroethylenehexafluoropropylene resins, vinyl fluoride resins, vinylidene fluoride resins, difluorodichloroethylene resins and copolymers thereof.

3. An electrophotographic photosensitive member according to claim 2, wherein said fluorine type resin powder is selected from the group consisting of tetrafluoroethylene resins and vinylidene fluoride resins.

4. An electrophotographic photosensitive member according to claim 2, wherein said fluorine type resin powder is tetrafluoroethylene resin.

5. An electrophotograhic photosensitive member according to claim 1, wherein the content of said fluorine type resin powder is 1 to 50% by weight of the components constituting the surface layer.

6. An electrophotograhic photosensitive member according to claim 1, wherein the amount of said fluorine type graft polymer added is 0.1 to 30% by weight based on the fluorine type resin powder.

7. An electrophotographic photosensitive member according to claim 1, wherein a binder resin in said surface layer is selected from the group consisting of polymethyl methacrylate and polycarbonate.

8. An electrophotographic photosensitive member according to claim 1, wherein said photosensitive layer has a laminated structure of a charge generation layer and a charge transport layer, and the charge transport layer is laminated on the charge generation layer.

9. An electrophotographic photosensitive member according to claim 1, wherein said photosensitive layer has a laminated structure of a charge generation layer and a charge transport layer, and the charge generation layer is laminated on the charge transport layer.

10. An electrophotographic photosensitive member according to claim 1, wherein said photosensitive layer comprises a single layer containing a charge generation substance and a charge transport substance.

11. An electrophotographic photosensitive member according to claim 1, wherein said photosensitive layer has a protective layer as the surface layer.

12. An electrophotographic photosensitive member according to claim 1, wherein said fluorine type graft polymer is a copolymer of a non-fluorine type oligomer having a polymerizable functional group at one terminal end and repeating units and a fluorine type polymerizable monomer.

13. An electrophotographic photosensitive member according to claim 1, wherein said fluorine type graft polymer is a copolymer of a fluorine type oligomer having a polymerizable functional group at one terminal end and repeating units and a non-fluorine type polymerizable monomer.

14. An electrophotographic photosensitive member according to claim 12, wherein said non-fluorine type oligomer has a molecular weight of 1,000 to 10,000 and said fluorine type graft polymer has molecular weight of 10,000 to 100,000.

15. An electrophotographic photosensitive member according to claim 13, wherein said fluorine type oligomer has a molecular weight of 1,000 to 10,000 and said fluorine type graft polymer has a molecular weight of 10,000 to 100,000.

16. An electrophotographic photosensitive member according to claim 12, wherein said non-fluorine type oligomer is a compound of formula (I) as follows:

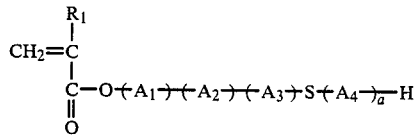

(I)

$R_1$ is hydrogen atom, alkyl group, halogen atom, halogen-substituted alkyl group, or aryl group;

$A_1$ is alkylene chain or halogen-substituted alkylene chain;

$A_2$ is

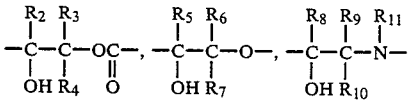

$R_2$–$R_{11}$ are each hydrogen atom, alkyl group or halogen-substituted alkyl group;

$A_3$ is an alkylene chain or halogen-substituted alkylene chain;

$A_4$ is a repeating unit of a polymer of at least one polymerizable monomer selected from the group consisting of low molecular weight straight chain unsaturated hydrocarbons, vinyl halides, vinyl esters of organic acids, vinylaromatic compounds, acrylic acid and methacrylic acid esters, N-vinyl compounds, vinylsilicon compounds, maleic anhydride, esters of maleic acid and fumaric acid;

a is a positive integer; and said fluorine-type polymerizable monomer is a Compound (II) selected from the group consisting of fluorine-substituted low molecular weight straight chain unsaturated hydrocarbons, fluorine-substituted vinyl halides, fluorine-substituted organic acid vinyl esters, fluorine-substituted alkyl vinyl ethers, fluorine-substituted alkyl esters and amides of acrylic acid and methacrylic acid, fluorine-substituted aromatic containing esters and amides of acrylic acid and methacrylic acid, fluorinated maleic anhydride, fluorine-substituted alkyl esters of maleic acid and fumaric acid, $\alpha$-fluorinated styrene and $\alpha$, $\beta$, $\beta$-fluorinated styrene.

17. An electrophotographic photosensitive member according to claim 13, wherein said fluorine type oligomer is represented by the formula (III) compounds as follows:

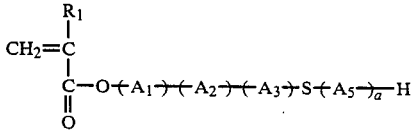

(III)

$A_5$ is a repeating unit of a polymer of at least one polymerizable monomer selected from the group consisting of fluorine-substituted low molecular weight straight chain unsaturated hydrocarbons, fluorine-substituted vinyl halides, fluorine-substituted organic acid vinyl esters, fluorine-substituted alkyl vinyl ethers, fluorine-substituted alkyl esters and amides of acrylic acid and methacrylic acid, fluorine-substituted aromatic containing esters and amides of acrylic acid and methacrylic acid, fluorinated maleic anhydride, fluorine-substituted alkyl esters of maleic acid and fumaric acid, α-fluorinated styrene and α, β, β-fluorinated styrene;

a is a positive integer;

$R_1$ is hydrogen atom, alkyl group, halogen atom, halogen-substituted alkyl group, or aryl group;

$A_1$ is an alkylene chain or halogen-substitute alkylene chain;

$A_2$ is

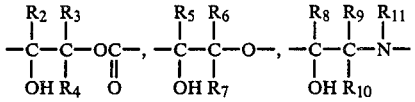

$R_2$–$R_{11}$ are each hydrogen atom, alkyl group or halogen-substituted alkyl group;

$A_3$ is an alkylene chain or halogen-substituted alkylene chain; and said non-fluorine type polymerizable monomer is selected from the group consisting of low molecular weight straight chain unsaturated hydrocarbons, vinyl halides, vinyl esters or organic acids, vinylaromatic compounds, acrylic acid and methacrylic acid esters, N-vinyl compounds, vinylsilicon compounds, maleic anhydride, esters of maleic acid and fumaric acid.

18. An electrophotographic photosensitive member according to claim 12, wherein said non-fluorine type oligomer is a compound represented by the formula (V) as follows:

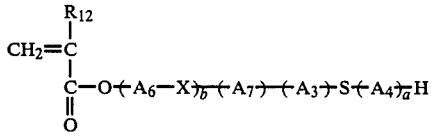

(V)

$R_{12}$ is hydrogen atom, alkyl group, halogen atom or halogen-substituted alkyl group;

$A_6$ is an alkylene chain;

X is

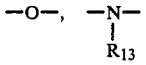

$R_{13}$ is hydrogen atom or alkyl group;

b is 0 or a positive integer;

$A_7$ is

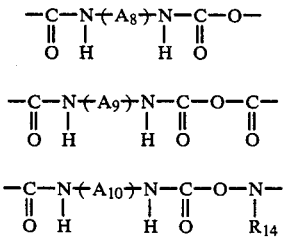

$R_{14}$ is hydrogen atom or alkyl group;

$A_8$, $A_9$, $A_{10}$ are each alkylene chain, cycloalkylene chain, substituted or unsubstituted arylene chain.

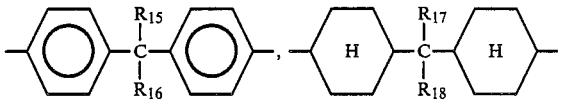

$R_{15}$, $R_{16}$, $R_{17}$, $R_{18}$ are each hydrogen atom, alkyl group, or $R_{15}$ and $R_{16}$ or $R_{17}$ and $R_{18}$ may form a ring through an alkylene chain;

$A_3$ is an alkylene chain or halogen-substituted alkylene chain;

$A_4$ is a repeating unit of a polymer of at least one polymerizable monomer selected from the group consisting of low molecular weight straight chain unsaturated hydrocarbons, vinyl halides, vinyl esters of organic acids, vinylaromatic compounds, acrylic acid and methacrylic acid esters, N-vinyl compounds, vinylsilicon compounds, maleic anhydride, esters of maleic acid and fumaric acid;

a is a positive integer; and said fluorine type polymerizable monomer is a Compound II selected from the group consisting of fluorine-substituted low molecular weight straight chain unsaturated hydrocarbons, fluorine-substituted vinyl halides, fluorine-substituted organic acid vinyl esters, fluorine-substituted alkyl vinyl ethers, fluorine-substituted alkyl esters and amides of acrylic acid and methacrylic acid, fluorine-substituted aromatic containing esters and amides of acrylic acid and methacrylic acid, fluorinated maleic anhydride, fluorine-substituted alkyl esters of maleic acid and fumaric acid, α-fluorinated styrene and α, β, β-fluorinated styrene.

19. An electrophotographic photosensitive member according to claim 13, wherein said fluorine type oligomer is a compound represented by the formula (VI) as follows:

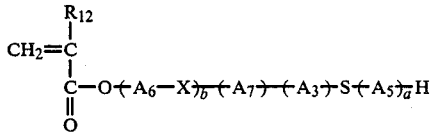

(VI)

$R_{12}$ is hydrogen atom, alkyl group, halogen atom or halogen-substituted alkyl group;

$A_6$ is an alkylene chain;

X is

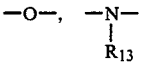

$R_{13}$ is hydrogen atom or alkyl group;

b is 0 or a positive integer;

$A_7$ is

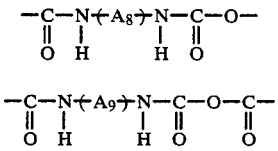

-continued

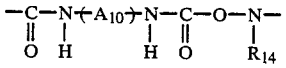

$R_{14}$ is hydrogen atom or alkyl group;

$A_8$, $A_9$, $A_{10}$ are each alkylene chain, cycloalkylene chain, substituted or unsubstituted arylene chain,

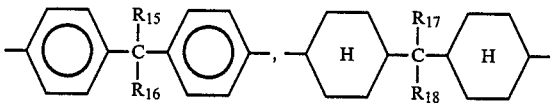

$R_{15}$, $R_{16}$, $R_{17}$, $R_{18}$ are each hydrogen atom, alkyl group, or $R_{15}$ and $R_{16}$ or $R_{17}$ and $R_{18}$ may form a ring through an alkylene chain;

$A_3$ is alkylene chain or halogen-substituted alkylene chain;

$A_5$ is a repeating unit of a polymer of at least one polymerizable monomer selected from the group consisting of fluorine-substituted low molecular weight straight chain unsaturated hydrocarbons, fluorine-substituted vinyl halides, fluorine-substituted organic acid vinyl esters, fluorine-substituted alkyl vinyl ethers, fluorine-substituted alkyl esters and amides of acrylic acid and methacrylic acid, fluorine-substituted aromatic containing esters and amides of acrylic acid and methacrylic acid, fluorinated maleic anhydride, fluorine-substituted alkyl esters of maleic acid and fumaric acid, α-fluorinated styrene and α, β, β-fluorinated styrene.

20. An electrophotographic photosensitive member according to claim 12, wherein said non-fluorine type oligomer is formed by the reaction of an active polymer intermediate having a polymerizable functional group at one terminal end and repeating units of the formula (VII) with a compound represented by the formula (VIII), the units of formula VII being:

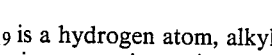

(VII)

$R_{19}$ is a hydrogen atom, alkyl group or aryl group;

$A_{11}$ is a repeating unit comprising a polymer of at least one selected from the group consisting of styrene, α-alkylstyrene, α-olefin, (meth)acrylic acid ester and α-cyano(meth)acrylic acid ester;

n is a positive integer;

$R_{20}$ is an alkylene chain;

m is 0 or a positive integer;

M is an alkali metal; wherein the formula VIII compounds are:

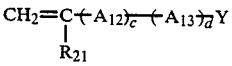

(VIII)

$R_{21}$ is a hydrogen atom, alkyl group or aryl group;

$A_{12}$ is

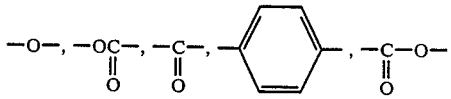

c is 0 or 1;

$A_{13}$ is a substituted or unsubstituted alkylene chain;

d is 0 or 1;

Y is a halogen atom; and said fluorine type polymerizable monomer is selected from the group consisting of fluorine-substituted low molecular weight straight chain unsaturated hydrocarbons, fluorine-substituted vinyl halides, fluorine-substituted organic acid vinyl esters, fluorine-substituted alkyl vinyl ethers, fluorine-substituted alkyl esters and amides of acrylic acid and methacrylic acid, fluorine-substituted aromatic containing esters and amides of acrylic acid and methacrylic acid, fluorinated maleic anhydride, fluorine-substituted alkyl esters of maleic acid and fumaric acid, α-fluorinated styrene and α, β, β-fluorinated styrene.

* * * * *

UNITED STATES PATENT AND TRADEMARK OFFICE

CERTIFICATE OF CORRECTION

PATENT NO. : 4,792,507

DATED : December 20, 1988

INVENTOR(S) : TOSHIYUKI YOSHIHARA, ET AL.

It is certified that error appears in the above-identified patent and that said Letters Patent is hereby corrected as shown below:

Title page:

IN [56] REFERENCES CITED

U.S. PATENT DOCUMENTS, "Fukada et al. should read --Fukuda et al.--.

COLUMN 2

Line 61, "end a" should read --end, and a--.

COLUMN 3

Line 22, "b" should read --be--.

COLUMN 6

Line 42, --(17)

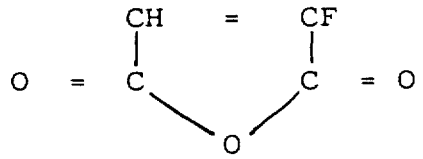

(18)

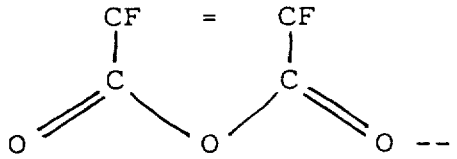

should be inserted.

Line 51, "non-fluorinetype" should read --non-fluorine type--.

UNITED STATES PATENT AND TRADEMARK OFFICE

CERTIFICATE OF CORRECTION

PATENT NO. : 4,792,507

DATED : December 20, 1988

INVENTOR(S) : TOSHIYUKI YOSHIHARA, ET AL. Page 2 of 4

It is certified that error appears in the above-identified patent and that said Letters Patent is hereby corrected as shown below:

COLUMN 9

Line 36, "$(R_{19}A_{11n}R_{20}\text{-}O]_m)^{\ominus} + M^{\oplus}$ (VII)" should read --$(R_{19}\text{-}[A_{11}]_n\text{-}[R_{20}\text{-}O]_m)^{\ominus} + M^{\oplus}$ (VII)--.

Line 46, --M; alkali metal-- should be inserted.

Line 68, "stopping" should be deleted.

COLUMN 10

Line 39, "selected" should read --be selected--.

Line 44, "etc., from" should be deleted and "like" should read --like.--.

COLUMN 15

Line 17, "methyacrylate" should read --methacrylate--.

COLUMN 16

Lines 1-2, "the average" should read --the number average--.

Line 39, "in divided" should read --in 3 divided--.

COLUMN 17

Line 49, "(weight average)." should read --6850 (weight average).--.

UNITED STATES PATENT AND TRADEMARK OFFICE

CERTIFICATE OF CORRECTION

PATENT NO. : 4,792,507

DATED : December 20, 1988

INVENTOR(S) : TOSHIYUKI YOSHIHARA, ET AL.

It is certified that error appears in the above-identified patent and that said Letters Patent is hereby corrected as shown below:

COLUMN 18

Line 56, "stopping" should be deleted.

COLUMN 21

Line 25, "(tradename" should read --(trade name--.

COLUMN 22

Line 46, "added was" should read --added and was--.

COLUMN 24

Line 16, "samples 6, and 8." should read --samples 6, 7, and 8.--.

COLUMN 29

Line 21, "electrophotograhic" should read --electrophotographic--.

Line 25, "electrophotograhic" should read --electrophotographic--.

UNITED STATES PATENT AND TRADEMARK OFFICE

CERTIFICATE OF CORRECTION

PATENT NO. : 4,792,507

DATED : December 20, 1988

INVENTOR(S) : TOSHIYUKI YOSHIHARA, ET AL. Page 4 of 4

It is certified that error appears in the above-identified patent and that said Letters Patent is hereby corrected as shown below:

COLUMN 34

Line 1, "$(R_{19}[A_{11}]_n[R_{20}-O]_m)^{\ominus} +M^{\oplus}$ (VII)" should read --$(R_{19}\text{-}[A_{11}]_n\text{-}[R_{20}-O]_m)^{\ominus} +M^{\oplus}$ (VII)--.

Signed and Sealed this

Twentieth Day of March, 1990

*Attest:*

JEFFREY M. SAMUELS

*Attesting Officer*

*Acting Commissioner of Patents and Trademarks*